US009894981B2

(12) United States Patent
Kim et al.

(10) Patent No.: US 9,894,981 B2
(45) Date of Patent: Feb. 20, 2018

(54) CONTAINER FOR CREAM-TYPE COSMETIC

(71) Applicant: YONWOO CO., LTD., Incheon (KR)

(72) Inventors: Hak-Chan Kim, Incheon (KR); Shin-Bok Jung, Incheon (KR)

(73) Assignee: YONWOO CO., LTD., Incheon (KR)

( * ) Notice: Subject to any disclaimer, the term of this patent is extended or adjusted under 35 U.S.C. 154(b) by 24 days.

(21) Appl. No.: 14/905,450

(22) PCT Filed: Nov. 25, 2013

(86) PCT No.: PCT/KR2013/010710
§ 371 (c)(1),
(2) Date: Jan. 15, 2016

(87) PCT Pub. No.: WO2015/008906
PCT Pub. Date: Jan. 22, 2015

(65) Prior Publication Data

US 2016/0157581 A1 Jun. 9, 2016

(30) Foreign Application Priority Data

Jul. 19, 2013 (KR) ..... 10-2013-0085125

(51) Int. Cl.
*A45D 40/00* (2006.01)
*A45D 34/04* (2006.01)
(Continued)

(52) U.S. Cl.
CPC ..... *A45D 40/0075* (2013.01); *A45D 34/04* (2013.01); *B05B 11/02* (2013.01);
(Continued)

(58) Field of Classification Search
CPC .... A45D 34/04; A45D 40/0075; B05B 11/02; B05B 11/3028; B05B 11/04;
(Continued)

(56) References Cited

U.S. PATENT DOCUMENTS 3,592,365 A * 7/1971 Schwartzman .... B65D 83/0055 222/209
4,154,366 A * 5/1979 Acres ..... B65D 83/0055 222/212
(Continued)

FOREIGN PATENT DOCUMENTS

KR 200361671 Y1 9/2004
KR 200387285 Y1 6/2005
(Continued)

OTHER PUBLICATIONS

International Search Report from International Application No. PCT/KR2013/010710 dated Apr. 30, 2014.
Korean Utility Model Registration No. 20-0311503.

*Primary Examiner* — J. Casimer Jacyna
(74) *Attorney, Agent, or Firm* — Marshall, Gerstein & Borun LLP

(57) ABSTRACT

A container for a cream-type cosmetic. The container for a cream-type cosmetic is configured to allow a button part to, when a user presses the button part, move downward by an elastic force of the button part itself and then return to the original position thereof while changing the pressure inside a body of the container to discharge contents therefrom. Thus, the container can easily discharge contents having a high viscosity through a simple structure without a separate pumping member. Therefore, manufacturing costs can be reduced assembly time can be shortened.

3 Claims, 10 Drawing Sheets

(51) Int. Cl.
*B05B 11/02* (2006.01)
*B05B 11/00* (2006.01)
*B65D 83/00* (2006.01)

(52) U.S. Cl.
CPC ..... *B05B 11/3028* (2013.01); *B65D 83/0033* (2013.01); *A45D 2200/055* (2013.01)

(58) Field of Classification Search
CPC ... B05B 11/041; B05B 11/042; B05B 11/043; B05B 11/045; B05B 11/047; B05B 11/048; B05B 11/0043; B65D 83/0055; B65D 83/0061
See application file for complete search history.

(56) References Cited

U.S. PATENT DOCUMENTS 5,271,432 A * 12/1993 Gueret ..... B05B 11/0043 137/854
5,379,919 A * 1/1995 Gueret ..... A45D 34/04 222/108
5,513,778 A 5/1996 Cardia et al.
2008/0081079 A1* 4/2008 Cha ..... A61K 33/14 424/680
2010/0276456 A1* 11/2010 Corbin ..... B05B 11/0024 222/205
2011/0106024 A1* 5/2011 Katayama ..... A61F 9/0008 604/294
2012/0193376 A1* 8/2012 Evans ..... A47K 5/1215 222/207
2015/0021331 A1* 1/2015 Hennemann ..... B05B 11/0045 220/495.05
2015/0260179 A1* 9/2015 Hatton ..... B05B 11/0043 417/395

FOREIGN PATENT DOCUMENTS

KR 1020100106658 A 10/2010
KR 101223827 B1 1/2013

* cited by examiner

CONTAINER FOR CREAM-TYPE COSMETIC

CROSS-REFERENCE TO RELATED APPLICATIONS

This U.S. utility patent application is a national stage application under 35 U.S.C. § 371 of international application PCT/KR2013/010710, filed Nov. 25, 2013, and claims the benefit of priority under 35 U.S.C. § 119 of Korean Patent Application No. 10-2013-0085125, filed Jul. 19, 2013, the entire contents of which are hereby incorporated herein by reference for all purposes.

TECHNICAL FIELD

Exemplary embodiments of the present invention relates to a container for cream-type cosmetics, and more particularly, to a container for cream-type cosmetics, which is configured to allow a button part to, when a user presses the button part, move downward by an elastic force of the button part itself and then return to the original position thereof while changing the pressure inside a body of the container to discharge contents therefrom, so that the container is able to easily discharge contents having high viscosity through a simple structure thereof without a separate pumping member, and thereby is able to reduce manufacturing costs as well as to shorten the assembling time period.

BACKGROUND

Generally, a cream-type cosmetic container storing high viscosity cream therein is configured to prevent contents held in the cosmetic container from coming into contact with the air. Such a vacuum-type cosmetic container was disclosed in Korean U.M. Registration No. 20-0311503, which was previously filed by the same applicant as the invention and then was registered.

The container in accordance with the cited document includes a container part storing contents therein, and a dispenser coupled to an upper end of the container part. The dispenser includes a cylinder that has on a lower end thereof a suction hole and is coupled to the upper end of the container part, a valve body that is provided in the suction hole of the cylinder, a button that has on an upper end thereof a plate part enlarged to cover a top of the container part and is provided in the cylinder to facilitate repetitive pumping operations, and a piston that is provided between an inner wall of the cylinder and a lower end of the button. Here, a slide hole is vertically formed in a central portion of the button, an upper end of the valve body extends upwards to be slidably inserted into the slide hole of the button, and a cover member is coupled to the upper end of the valve body to cover the slide hole of the button. Thus, if the button is pressed down, the button moves downward along an outer circumference of the valve body, so that a gap is created between the cover member and the button, and contents are discharged through the gap to be collected on the plate part of the button.

However, the container in accordance with the cited document configured as described above is problematic in that the dispenser including the cylinder that has on the lower end thereof the suction hole is coupled to an upper portion of the container part to discharge contents out from the container part, so that a pumping operation is performed through the dispenser of a complicated structure, and thereby an assembling time period for installing the dispenser is increased, and in addition, manufacturing costs are inevitably increased.

SUMMARY OF THE DISCLOSURE

Accordingly, the present invention has been made keeping in mind the above problems occurring in the prior art, and an embodiment of the present invention relates to a container for cream-type cosmetics, which is configured to allow a button part to, when a user presses the button part, move downward by an elastic force of the button part itself and then return to the original position thereof while changing the pressure inside a body of the container to discharge contents therefrom, so that the container is able to easily discharge contents having high viscosity through a simple structure thereof without a separate pumping member, and thereby is able to reduce manufacturing costs as well as to shorten the assembling time period.

Another embodiment of the present invention relates to a container for cream-type cosmetics, in which a valve member is provided on an inner lower end of a container body to prevent a piston from moving downward by internal pressure generated during pumping action resulting from up-and-down movement of a button part.

A container for cream-type cosmetics in accordance with a first embodiment of the present invention may include a container body 100 accommodating contents therein, with a piston 110 provided in the container body to move upward as the contents are used; a pumping guide cap 200, 200' coupled to an upper portion of the container body 100, and elastically deformed as a user presses the pumping guide cap to change pressure in the container body 100 and thereby discharging the contents out from the container body 100; and a closing cap 300 coupled to the upper portion of the container body 100 while surrounding the pumping guide cap 200.

In the container in accordance with the first embodiment of the present invention, the pumping guide cap 200 may include a coupling part 210 coupled to the upper portion of the container body 100 to secure the pumping guide cap 200 to the container body 100; and a button part 220 moving downward as a user presses the button part and then returning to an original position thereof, guiding a pumping operation by changing pressure in the container body 100, and made of an elastic material, with a contents discharge hole 221 formed in a central portion of the button part 220 to discharge the contents in response to a pumping operation.

In the container in accordance with the first embodiment of the present invention, the pumping guide cap 200' may include a coupling part 210' coupled to the upper portion of the container body 100 to secure the pumping guide cap 200' to the container body 100; a button part 220' located at one side of an upper end of the pumping guide cap 200', moving downward as a user presses the button part and then returning to an original position thereof, guiding a pumping operation by changing pressure in the container body 100, and made of an elastic material; and a contents discharge hole 230 located at the other side of the upper end of the pumping guide cap 200' to discharge the contents by operating the button part 220'.

In the container in accordance with the first embodiment of the present invention, a valve member 140 may be provided on an inner lower end of the container body 100 to control a flow of air and thereby prevent the piston 110 from moving downward during a pumping operation through an operation of the pumping guide cap 200, 200'.

In the container in accordance with the first embodiment of the present invention, a valve support 120 may be provided on the inner lower end of the container body 100, and may protrude upward from a bottom surface of the container body 100 to support the valve member 140, with an air inlet hole 121 formed in a central portion of the valve support.

In the container in accordance with the first embodiment of the present invention, an air flow hole 130 may be formed in the inner lower end of the container body 100 to allow air to flow into the container body 100 when the valve member 140 opens the air inlet hole 121.

A container for cream-type cosmetics in accordance with a first embodiment of the present invention may include a container body 400; an inner container 500 coupled to an interior of the container body 400, accommodating contents therein, contracted as the contents are used, and made of a soft material; a pumping guide cap 600, 600' coupled to an upper portion of the container body 400, and elastically deformed as a user presses the pumping guide cap to change pressure in the inner container 500 and thereby discharging the contents out from the inner container 500; and a closing cap 700 coupled to the upper portion of the container body 400 while surrounding the pumping guide cap 600, 600'.

In the container in accordance with the second embodiment of the present invention, the pumping guide cap 600 may include a coupling part 610 coupled to the upper portion of the container body 400 to secure the pumping guide cap 600 to the container body 400; and a button part 620 moving downward as a user presses the button part and then returning to an original position thereof, guiding a pumping operation by changing pressure in the inner container 500, and made of an elastic material, with a contents discharge hole 621 formed in a central portion of the button part to discharge the contents in response to the pumping operation.

In the container in accordance with the second embodiment of the present invention, the pumping guide cap 600' may include a coupling part 610' coupled to the upper portion of the container body 400 to secure the pumping guide cap 600' to the container body; a button part 620' located at one side on an upper end of the pumping guide cap 600', moving downward as a user presses the button part and then returning to an original position thereof, guiding a pumping operation by changing pressure in the inner container 500, and made of an elastic material; and a contents discharge hole 630 located at the other side on the upper end of the pumping guide cap 600' to discharge the contents by pressing the button part 620'.

In the container in accordance with the second embodiment of the present invention, a valve member 430 may be provided on an inner lower end of the container body 400 to control a flow of air and thereby keep the inner container 500 contracted during a pumping operation through an operation of the pumping guide cap 600, 600'.

In the container in accordance with the second embodiment of the present invention, a valve support 410 may be provided on the inner lower end of the container body 400, and may protrude upward from a bottom surface of the container body 400 to support the valve member 430, with an air inlet hole 411 formed in a central portion of the valve support.

In the container in accordance with the second embodiment of the present invention, an air flow hole 420 may be formed in the inner lower end of the container body 400 to allow air to flow into the container body 400 when the valve member 430 opens the air inlet hole 411.

In accordance with the present invention, there is an advantage in that a container for cream-type cosmetics is configured to allow a button part to, when a user presses the button part, move downward by an elastic force of the button part itself and then return to the original position thereof while changing the pressure inside a body of the container to discharge contents therefrom, so that the container is able to easily discharge contents having high viscosity through a simple structure thereof without a separate pumping member, and thereby is able to reduce manufacturing costs as well as to shorten the assembling time period.

In accordance with the present invention, there is another advantage in that a valve member is provided on an inner lower end of a container body to prevent a piston from moving downward by internal pressure generated during pumping action resulting from up-and-down movement of a button part.

DETAILED DESCRIPTION

Figure 1:
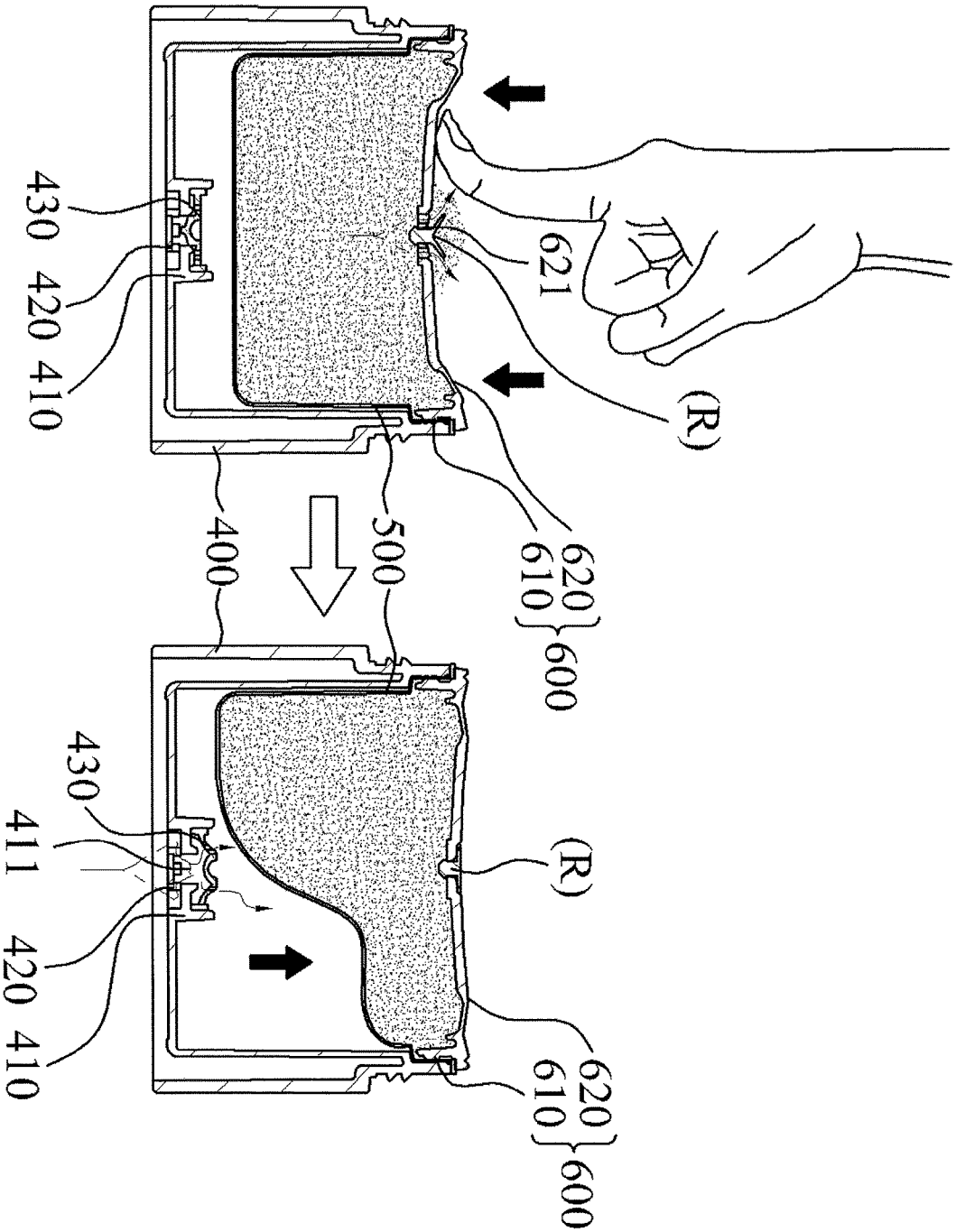
FIG. 1 is an exploded sectional view showing a configuration of a container for cream-type cosmetics in accordance with a first embodiment of the present invention.

Hereinafter, the present invention will be described in detail with reference to accompanying drawings. The same reference numerals denote the same elements throughout different drawings.

Figure 2:
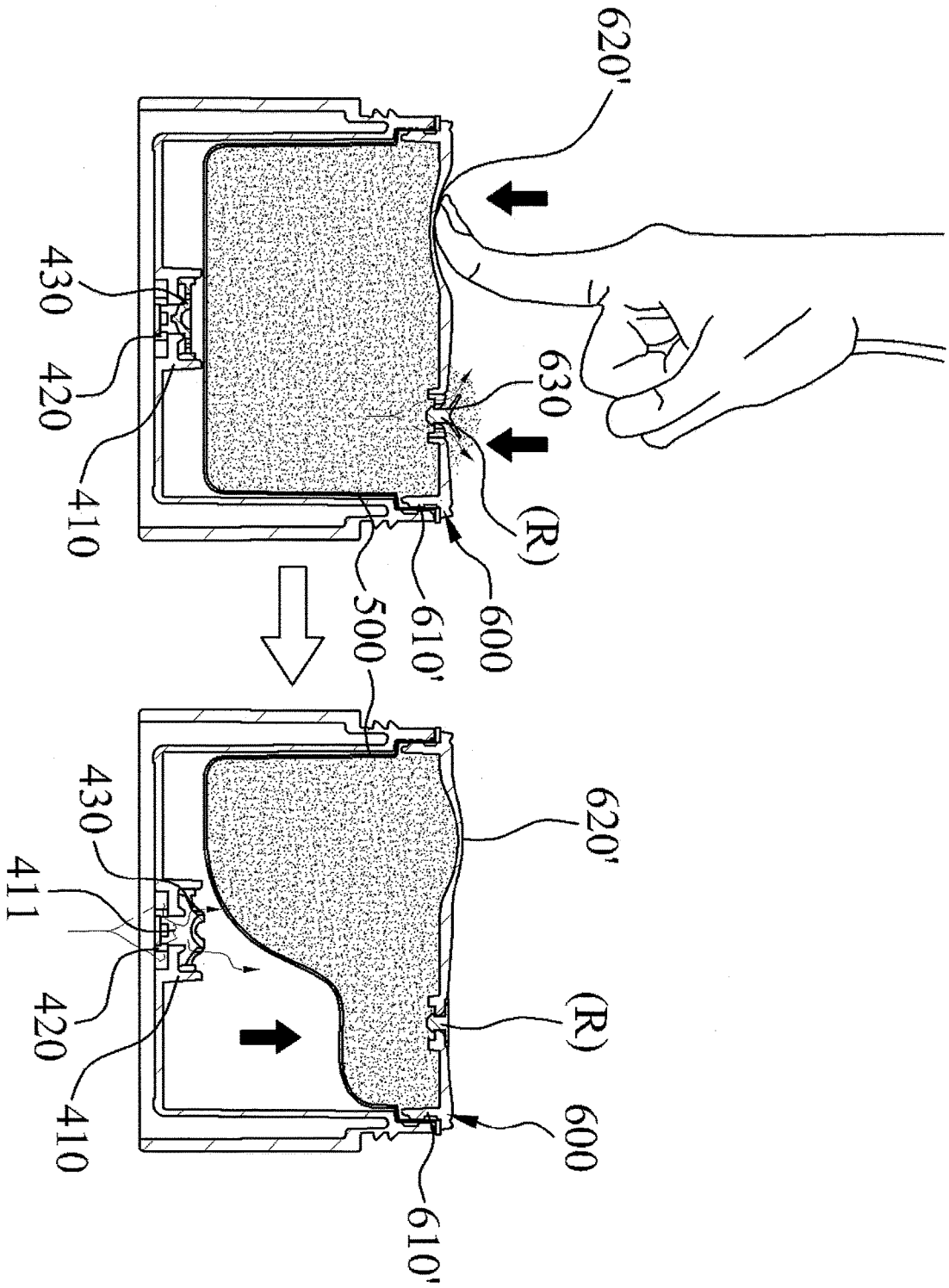
FIG. 2 is an assembled sectional view showing the configuration of the container for the cream-type cosmetics in accordance with the first embodiment of the present invention.

FIG. 1 is an exploded sectional view showing a configuration of a container for cream-type cosmetics in accordance with a first embodiment of the present invention, and FIG. 2 is an assembled sectional view showing the configuration of the container for the cream-type cosmetics in accordance with the first embodiment of the present invention.

Referring to FIGS. 1 and 2, the container for cream-type cosmetics in accordance with the first embodiment of the present invention includes a container body 100, a pumping guide cap 200, and a closing cap 300.

The container body 100 accommodates contents therein, with a piston 110 provided in the container body to move upward as the contents are used.

In the present invention, a valve member 140 is installed at an inner lower end of the container body 100 to control the flow of air and thereby prevent the piston 110 from moving downward by internal pressure of the container body 100, which is generated during a pumping operation through an operation of the pumping guide cap 200 that will be described below. To this end, a valve support 120 is provided on the inner lower end of the container body 100, and protrudes upward from a bottom surface of the container body 100 to support the valve member 140.

An air inlet hole 121 is formed in a central portion of the valve support 120 to be opened or closed by the valve member 140. An air flow hole 130 is formed in the inner lower end of the container body 100 to allow air to flow into the container body 100 when the valve member 140 opens the air inlet hole 121.

The pumping guide cap 200 is coupled to an upper portion of the container body 100 to close an opening formed in an upper end of the container body 100, and is provided with a coupling part 210 that is coupled to the upper portion of the container body 100 to allow the pumping guide cap 200 to be secured to the upper portion of the container body 100.

In the present invention, the pumping guide cap 200 is provided with a button part 220 that is elastically deformed as a user presses it and changes pressure in the container body 100 to discharge the contents out from the container body 100. The button part 220 is operated such that an entire upper surface thereof moves downward if a user presses an upper end thereof, and the button part returns to an original position thereof if he or she releases the button part. The button part guides the pumping operation by changing pressure in the container body 100, and is made of an elastic material to be elastically deformable depending on a user presses the button part.

A contents discharge hole 221 is formed in a central portion of the button part 220 to discharge the contents in response to a pumping operation. The upper end of the button part 220 is more deeply recessed towards the central portion at which the contents discharge hole 221 is formed, so that it is possible to discharge the contents to the upper end of the button part 220 and to use the contents.

The closing cap 300 is coupled to the upper portion of the container body 100 while surrounding the pumping guide cap 200. The closing cap prevents the malfunction of the button part 220, prevents foreign matter from falling onto the upper end of the button part 220, and prevents a rubber tip R from being damaged by external impact.

Meanwhile, a pressing protrusion 310 is formed on an upper end in the closing cap 300 to press the upper end of the pumping guide cap 200 and thereby prevent the pumping guide cap 200 from being separated from the container body 100.

Hereinafter, an operational state of the container for cream-type cosmetics in accordance with the first embodiment of the present invention will be described with reference to FIG. 3.

Figure 3:
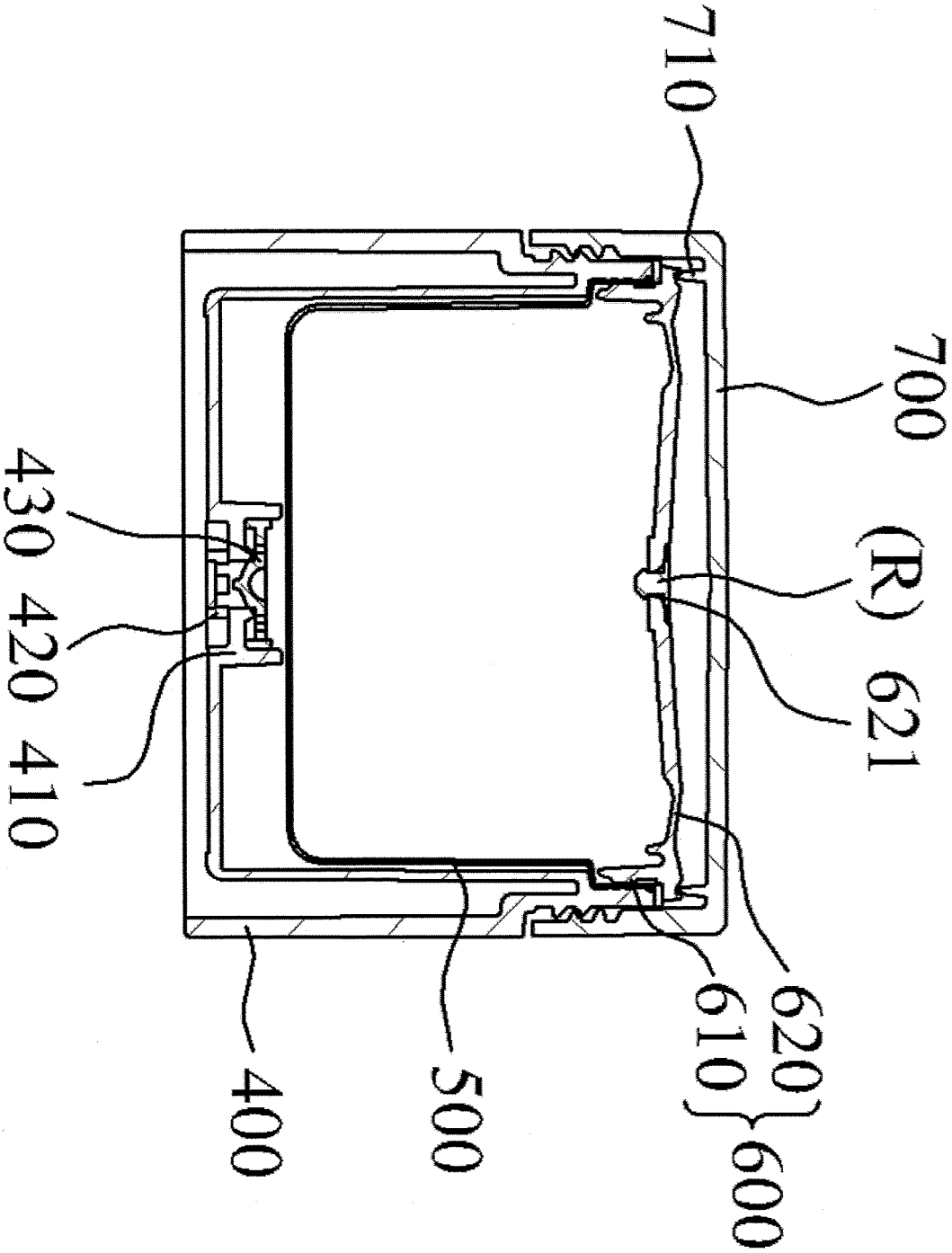
FIG. 3 is a view showing an operational state of the container for the cream-type cosmetics in accordance with the first embodiment of the present invention.

FIG. 3 is a view showing the operational state of the container for the cream-type cosmetics in accordance with the first embodiment of the present invention. Referring to FIG. 3, the container for the cream-type cosmetics in accordance with the first embodiment of the present invention is operated as follows: when a user presses the upper end of the button part 220, the button part 220 made of the elastic material moves downward. At this time, the internal pressure of the container body 100 is generated, so that the contents accommodated in the container body 100 push the rubber tip R that closes the contents discharge hole 221 and then are discharged to an upper surface of the button part 220 through the contents discharge hole 221.

As such, in order to prevent the piston 110 from moving downward by the internal pressure of the container body 100 that is generated during the pumping operation as the upper end of the button part 220 is pressed, the valve member 140 controlling the air flow is preferably installed at the inner lower end of the container body 100. The valve member 140 is configured to close the air inlet hole 121 during the pumping operation as the upper end of the button part 220 is pressed.

Meanwhile, if a user releases the upper end of the button part 220, the button part 220 moves upward while returning to the original position thereof by its own elastic force. At this time, the piston 110 moves upward in proportion to the discharged amount of the contents. As the piston 110 moves upward, the valve member 140 opens the air inlet hole 121 and thereby air flowing through the air flow hole 130 is introduced into the container body 100 through the air inlet hole 121.

Hereinafter, a container for cream-type cosmetics in accordance with a second embodiment of the present invention will be described with reference to FIGS. 4 to 6.

Figure 4:
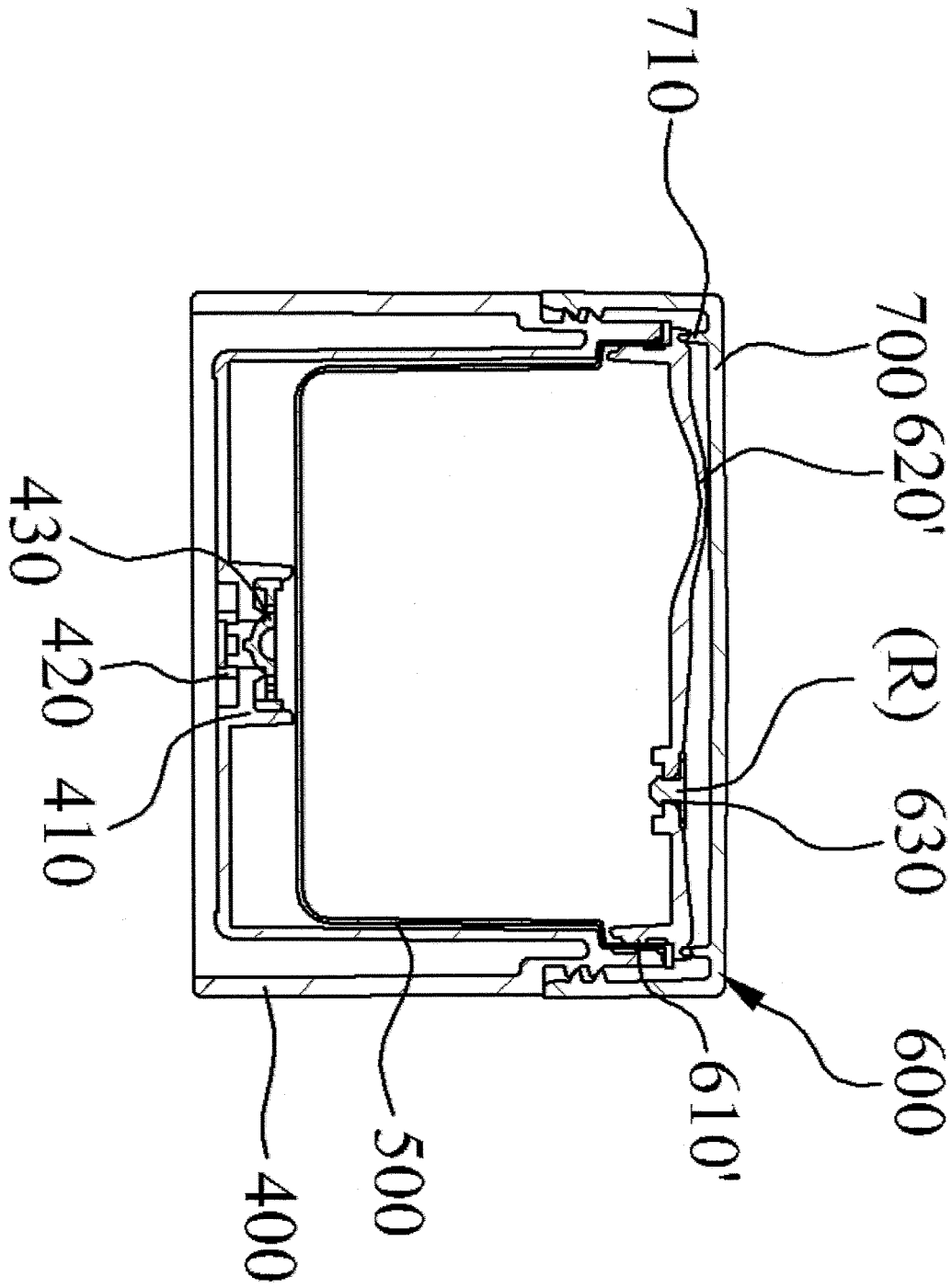
FIG. 4 is an exploded sectional view showing the configuration of the container for the cream-type cosmetics in accordance with the first embodiment of the present invention.
Figure 5:
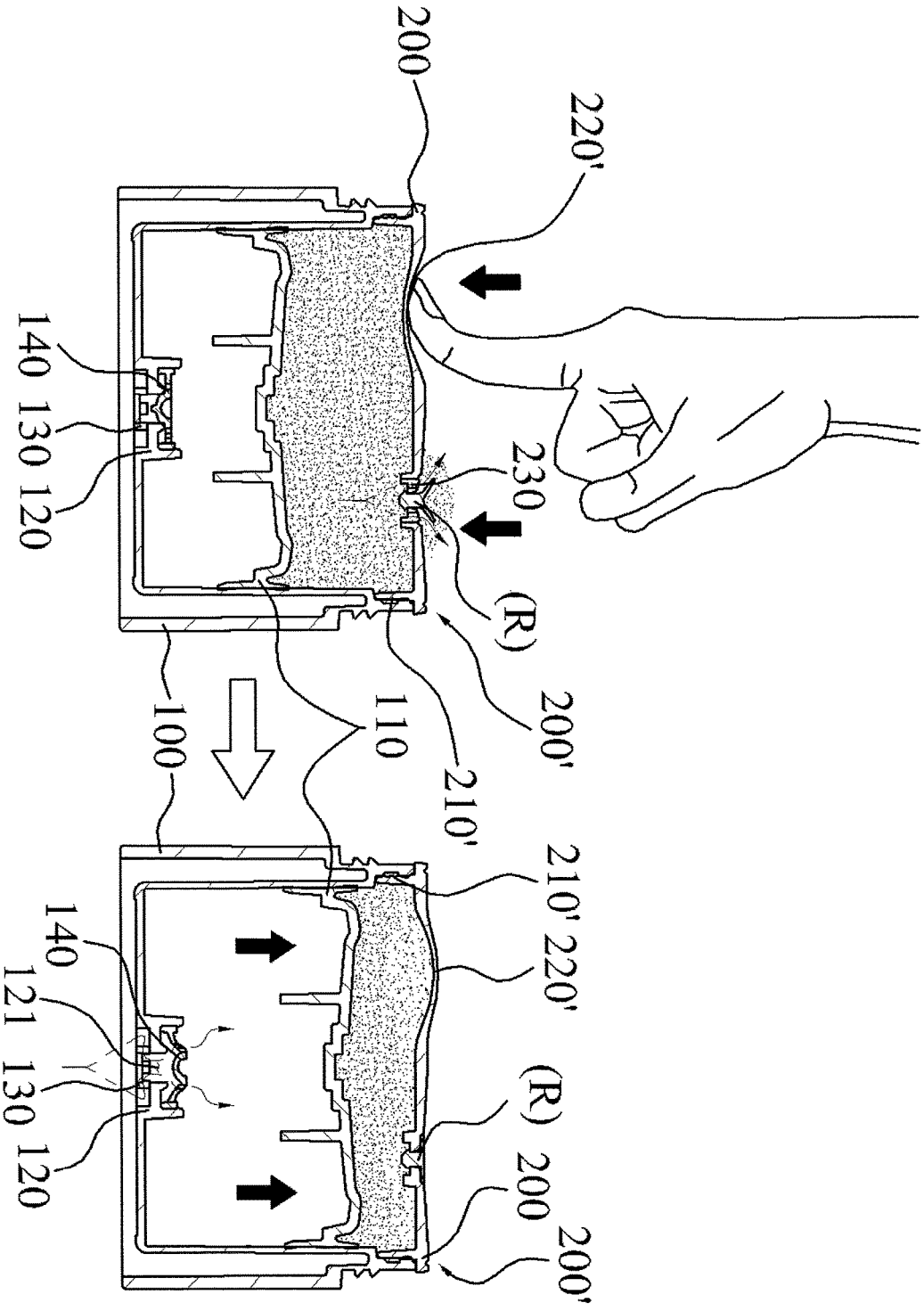
FIG. 5 is an assembled sectional view showing a configuration of a container for cream-type cosmetics in accordance with a second embodiment of the present invention.
Figure 6:
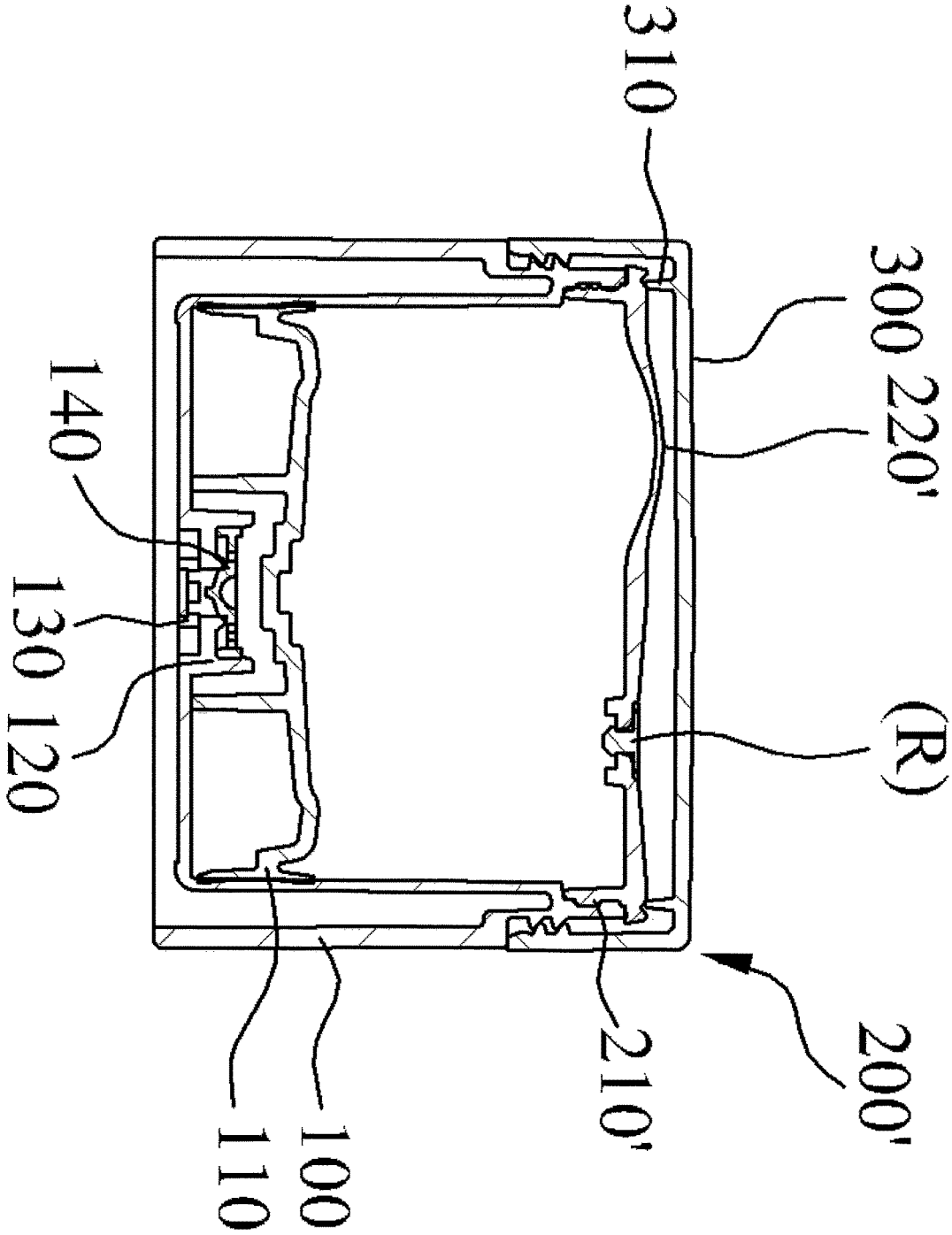
FIG. 6 is a view showing an operational state of the container for the cream-type cosmetics in accordance with the second embodiment of the present invention.

FIG. 4 is an exploded sectional view showing the configuration of the container for the cream-type cosmetics in accordance with the first embodiment of the present invention, FIG. 5 is an assembled sectional view showing the configuration of the container for cream-type cosmetics in accordance with the second embodiment of the present invention, and FIG. 6 is a view showing an operational state of the container for the cream-type cosmetics in accordance with the second embodiment of the present invention.

Referring to FIGS. 4 to 6, the container for the cream-type cosmetics in accordance with the second embodiment of the present invention has a button part 220' that is formed on one side of an upper end of a pumping guide cap 200' coupled to an upper portion of the container body 100 by a coupling part 210', moves downward as a user presses the button part and then return to an original position thereof, changes pressure in the container body 100 to guide a pumping operation, and is made of an elastic material. A contents discharge hole 230 is formed in the other side of the upper end of the pumping guide cap 200' to discharge the contents by operating the button part 220'.

An operation of the container for cream-type cosmetics in accordance with the second embodiment of the present invention is as follows. When a user presses the button part 220' formed on one side of the pumping guide cap 200', the button part 220' made of the elastic material moves downward. At this time, the internal pressure of the container body 100 is generated, so that the contents accommodated in the container body 100 push the rubber tip R that closes the contents discharge hole 230 formed in the other side of the pumping guide cap 200', and are discharged to the upper surface of the pumping guide cap 200' through the contents discharge hole 230.

As such, in order to prevent the piston 110 from moving downward by the internal pressure of the container body 100, generated during the pumping operation as the button part 220' is pressed, a valve member 140 is preferably installed at the inner lower end of the container body 100 to control the flow of air, similarly to the first embodiment. The valve member 140 is configured to close the air inlet hole 121 during the pumping operation as the button part 220' is pressed.

Meanwhile, if a user releases the upper end of the button part 220', the button part 220' moves upward while returning to the original position thereof by its own elastic force. At this time, the piston 110 moves upward in proportion to the discharged amount of the contents. As the piston 110 moves upward, the valve member 140 opens the air inlet hole 121 and thereby air flowing through the air flow hole 130 is introduced into the container body 100 through the air inlet hole 121.

Since the remaining configuration is equal in function and structure to the first embodiment of the present invention, a duplicated description thereof will be omitted herein.

Hereinafter, a container for cream-type cosmetics in accordance with a third embodiment of the present invention will be described with reference to FIGS. 7 and 8.

Figure 7:
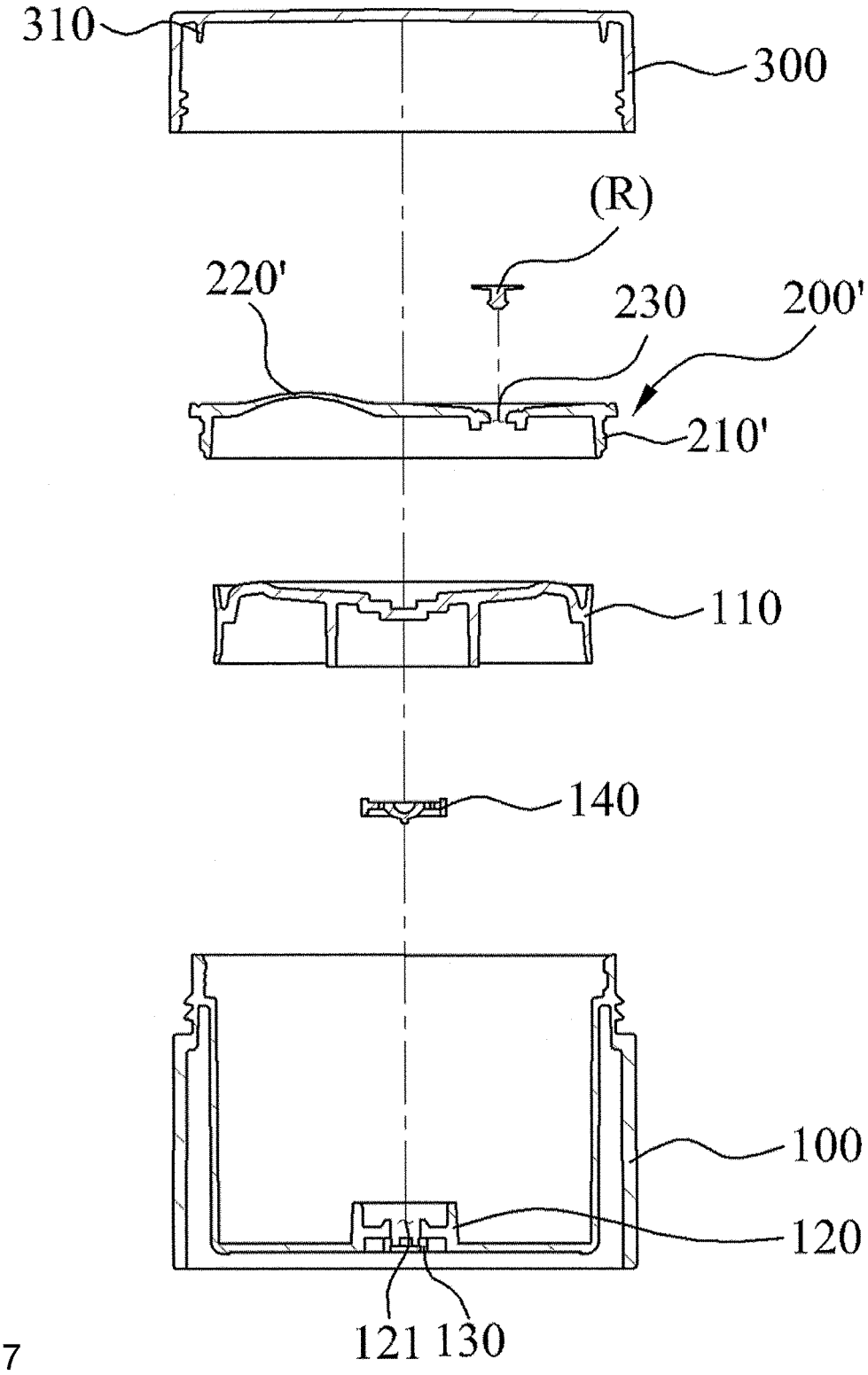
FIG. 7 is a sectional view showing a configuration of a container for cream-type cosmetics in accordance with a third embodiment of the present invention.
Figure 8:
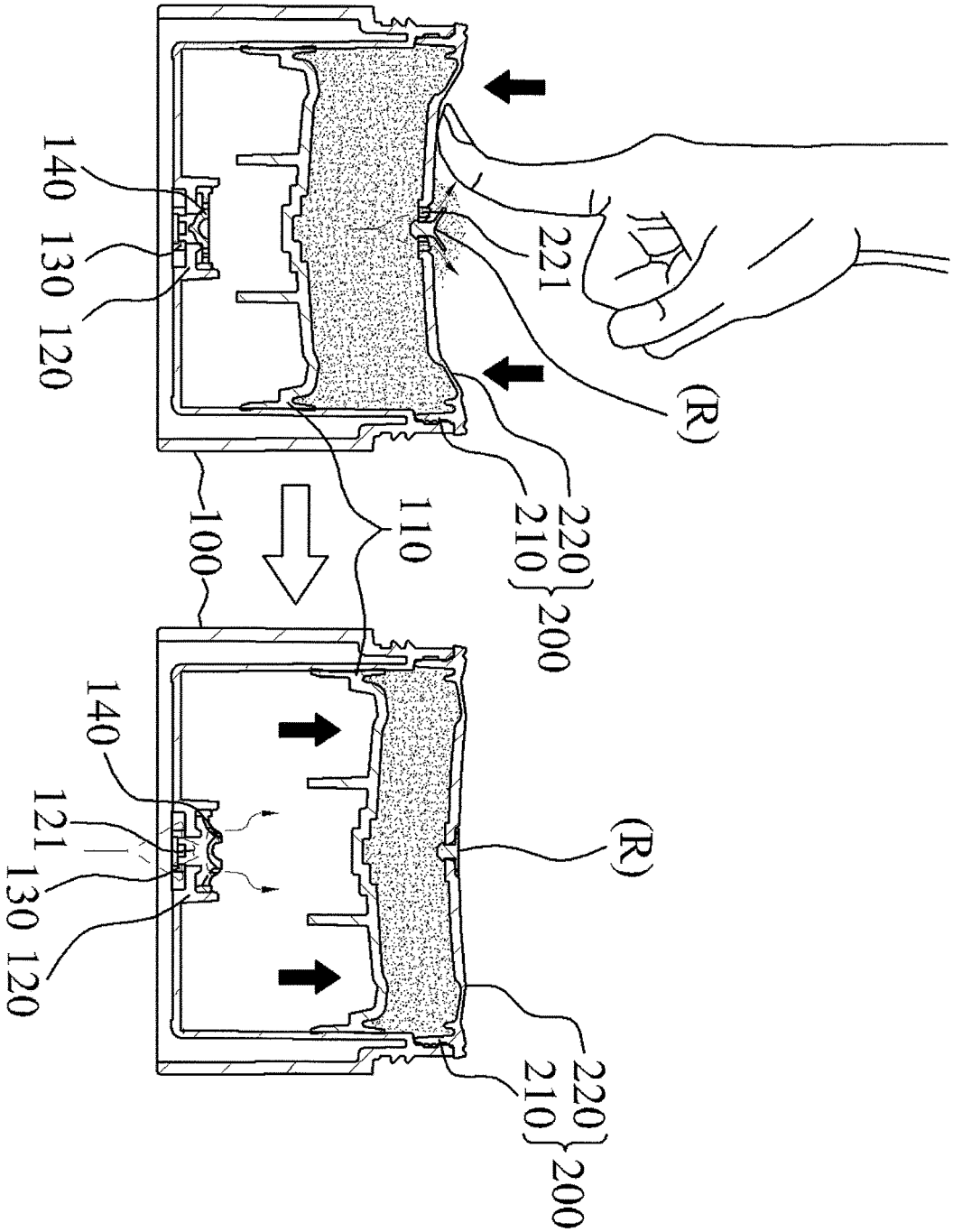
FIG. 8 is a view showing an operational state of the container for the cream-type cosmetics in accordance with the third embodiment of the present invention.

FIG. 7 is a sectional view showing a configuration of the container for cream-type cosmetics in accordance with the third embodiment of the present invention, and FIG. 8 is a view showing an operational state of the container for the cream-type cosmetics in accordance with the third embodiment of the present invention.

Referring to FIGS. 7 and 8, the container for the cream-type cosmetics in accordance with the third embodiment of the present invention is configured such that an inner container 500 accommodating contents therein is separately coupled to an interior of the container body 400, unlike the first embodiment where the contents are accommodated in the container body 100 and the piston 110 is provided in the container body 100 to move upward as the contents are used. This container is characterized in that the inner container 500 is made of a soft material to be contracted as the contents are used.

The container for the cream-type cosmetics in accordance with the third embodiment of the present invention is configured such that, when a user presses a button part 620 constituting the upper end of a pumping guide cap 600 coupled to the upper portion of the container body 400 via a coupling part 610, the button part 620 made of an elastic material moves downward. At this time, internal pressure is generated in the inner container 500, so that the contents accommodated in the inner container 500 push a rubber tip R closing a contents discharge hole 621 and then are discharged to the upper surface of the button part 620 through the contents discharge hole 621.

As such, if the pumping operation is performed by pressing the upper end of the button part 620, the contents are discharged and then the inner container 500 is deformed to be contracted. Here, in order to keep the inner container 500 contracted, the valve member 430 is preferably provided on the inner lower end of the container body 400 to be installed at the valve support 410 and thereby control the air flow. The valve member 430 is configured to close the air inlet hole 411 and thereby block the inflow of air into the container body 400 when the upper end of the button part 620 is pressed, and is configured to open the air inlet hole 411 and thereby allow air flowing through the air flow hole 420 to flow through the air inlet hole 411 into the container body 400 when the upper end of the button part 620 is released.

Meanwhile, a closing cap 700 is coupled to the upper portion of the container body 400 to surround the pumping guide cap 600. The closing cap 700 prevents the malfunction of the button part 620, prevents foreign matter from falling onto the upper end of the button part 620, and prevents the rubber tip R from being damaged by external impact.

A pressing protrusion 710 is formed on an upper end in the closing cap 700 to press the upper end of the pumping guide cap 600 and thereby prevent the pumping guide cap 600 from being separated from the container body 400.

Hereinafter, a container for cream-type cosmetics in accordance with a fourth embodiment of the present invention will be described with reference to FIGS. 9 and 10.

Figure 9:
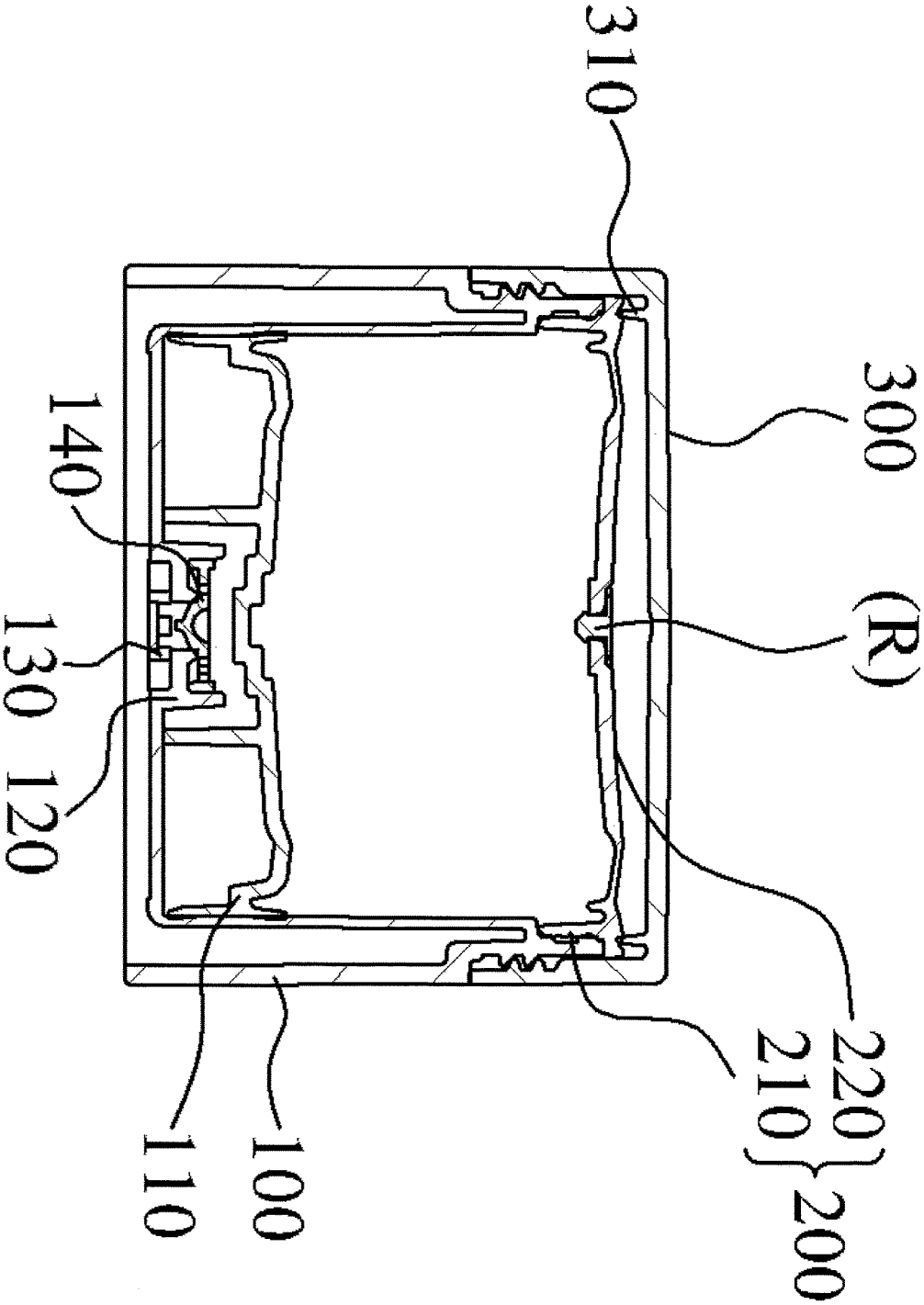
FIG. 9 is a sectional view showing a configuration of a container for cream-type cosmetics in accordance with a fourth embodiment of the present invention.
Figure 10:
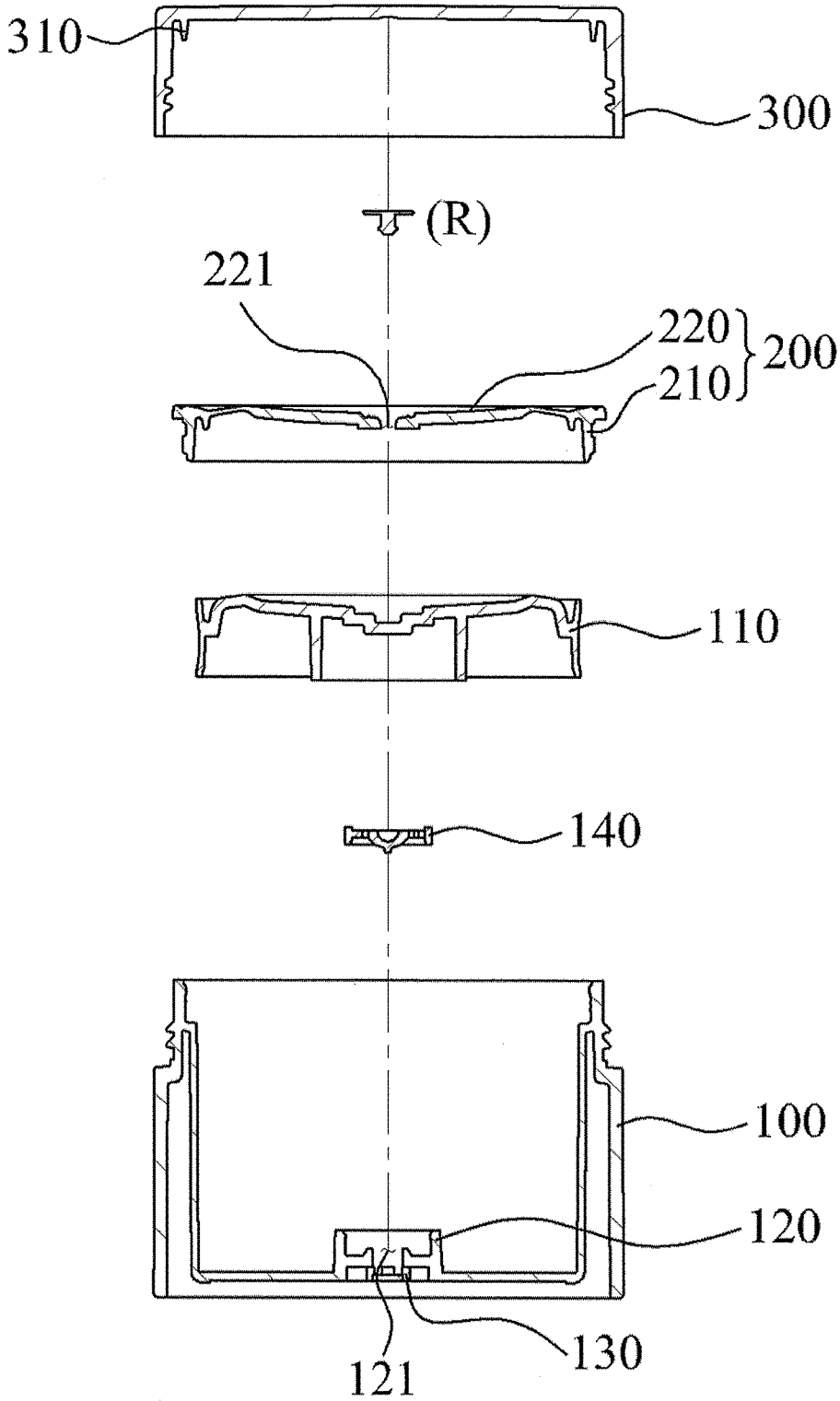
FIG. 10 is a view showing an operational state of the container for the cream-type cosmetics in accordance with the fourth embodiment of the present invention.

FIG. 9 is a sectional view showing a configuration of the container for cream-type cosmetics in accordance with the fourth embodiment of the present invention, and FIG. 10 is a view showing an operational state of the container for the cream-type cosmetics in accordance with the fourth embodiment of the present invention Referring to FIGS. 9 and 10, the container for cream-type cosmetics in accordance with the fourth embodiment of the present invention is configured such that an inner container 500 accommodating contents therein is separately coupled to an interior of the container body 400, unlike the second embodiment where the contents are accommodated in the container body 100 and the piston 110 is provided in the container body 100 to move upward as the contents are used. This container is characterized in that the inner container 500 is made of a soft material to be contracted as the contents are used.

The container for the cream-type cosmetics in accordance with the fourth embodiment of the present invention is configured such that, when a user presses a button part 620' formed on one side of a pumping guide cap 600' coupled to the upper portion of the container body 400 via a coupling part 610', the button part 620' made of an elastic material moves downward. At this time, internal pressure is generated in the inner container 500, so that the contents accommodated in the inner container 500 push a rubber tip R closing a contents discharge hole 630 formed on the other side of the pumping guide cap 600' and then are discharged to the upper surface of the pumping guide cap 600' through the contents discharge hole 630.

As such, if the pumping operation is performed by pressing the button part 620', the contents are discharged and then the inner container 500 is deformed to be contracted. Here, in order to keep the inner container 500 contracted, the valve member 430 is preferably provided on the inner lower end of the container body 400 to control the air flow. The valve member 430 is configured to close the air inlet hole 411 and thereby block the inflow of air into the container body 400 when the button part 620' is pressed, and is configured to open the air inlet hole 411 and thereby allow air flowing through the air flow hole 420 to flow through the air inlet hole 411 into the container body 100 when the upper end of the button part 620' is released.

Since the remaining configuration is equal in function and structure to the third embodiment of the present invention, a duplicated description thereof will be omitted herein.

Preferred embodiments of the present invention have been described herein with reference to the accompanying drawings. It is to be understood that the terminology employed herein is for the purpose of description and not of limitation. Therefore, it will be obvious to those skilled in the art that many modifications and variations of the present invention are possible without departing from the spirit and the scope of the appended claims.

The invention claimed is:

1. A container for cream-type cosmetics, comprising:

a container body;

an inner container coupled to an interior of the container body, accommodating contents therein, contracted as the contents are used, and made of a soft material;

a pumping guide cap coupled to an upper portion of the container body, and elastically deformed as a user presses the pumping guide cap to change pressure in the inner container and thereby discharging the contents out from the inner container; and a closing cap coupled to the upper portion of the container body while surrounding the pumping guide cap, wherein a valve member is provided on an inner lower end of the container body to control a flow of air and thereby keep the inner container contracted during a pumping operation through an operation of the pumping guide cap, wherein a valve support is provided on the inner lower end of the container body, and protrudes upward from a bottom surface of the container body to support the valve member, with an air inlet hole formed in a central portion of the valve support, and wherein an air flow hole is formed in the inner lower end of the container body to allow air to flow into the container body when the valve member opens the air inlet hole.

2. The container of claim 1, wherein the pumping guide cap comprises:

a coupling part coupled to the upper portion of the container body to secure the pumping guide cap to the container body; and a button part moving downward as a user presses the button part and then returning to an original position thereof, guiding a pumping operation by changing pressure in the inner container, and made of an elastic material, with a contents discharge hole formed in a central portion of the button part to discharge the contents in response to the pumping operation.

3. The container of claim 1, wherein the pumping guide cap comprises:

a coupling part coupled to the upper portion of the container body to secure the pumping guide cap to the container body;

a button part located at one side on an upper end of the pumping guide cap, moving downward as a user presses the button part and then returning to an original position thereof, guiding a pumping operation by changing pressure in the inner container, and made of an elastic material; and a contents discharge hole located at the other side on the upper end of the pumping guide cap to discharge the contents by pressing the button part.

* * * * *